US006905410B2

(12) United States Patent
Kusuda et al.

(10) Patent No.: US 6,905,410 B2
(45) Date of Patent: Jun. 14, 2005

(54) GAMING MACHINE AND OPERATION METHOD THEREFOR

(75) Inventors: Kazuhiro Kusuda, Kanagawa (JP); Yosuke Sasaki, Kanagawa (JP); Kazuhiro Yoshida, Kanagawa (JP); Yasuhiro Tanaka, Kanagawa (JP)

(73) Assignee: Konami Corporation, Tokyo (JP)

( * ) Notice: Subject to any disclaimer, the term of this patent is extended or adjusted under 35 U.S.C. 154(b) by 340 days.

(21) Appl. No.: 09/730,927

(22) Filed: Dec. 6, 2000

(65) Prior Publication Data

US 2001/0008845 A1 Jul. 19, 2001

(30) Foreign Application Priority Data

Dec. 24, 1999 (JP) ..... 11-368517

(51) Int. Cl.[7] ..... A63F 9/24
(52) U.S. Cl. ..... 463/25
(58) Field of Search ..... 463/25; 700/91–93

(56) References Cited

U.S. PATENT DOCUMENTS 5,564,977 A * 10/1996 Algie ..... 463/25

FOREIGN PATENT DOCUMENTS

JP 10-179843 9/1986
WO WP 95/22883 8/1995

OTHER PUBLICATIONS

Examination Guidelines for Computer–Related Inventions, Final Version; Patent and Trademark Office, United States Department of Commerce; pp. 1–41 [http://www.uspto.gov/web/patents/guides.htm].*

* cited by examiner

*Primary Examiner*—Mark Sager
(74) *Attorney, Agent, or Firm*—Bachman & LaPointe, P.C.

(57) ABSTRACT

An operation method for a gaming machine sets a target payout rate, probabilities of winning, and odds on a plurality of objects. The objects are rearranged in order of the probability of winning. The odds on the object in first place are corrected to odds with a predetermined number of digits. The probability of winning of the object in the first place is corrected by the corrected odds. The difference between the uncorrected probability of winning and the corrected probability of winning is reflected in the probability of winning of the object in the subsequent place. The odds on the object in the subsequent place are predetermined based on the corrected probability of winning of the object in the subsequent place. The whole processing is repetitively performed for the objects in all places.

10 Claims, 4 Drawing Sheets

GAMING MACHINE AND OPERATION METHOD THEREFOR

BACKGROUND OF THE INVENTION

1. Field of the Invention

The present invention relates to gaming machines in which racing, such as horse racing, bicycle racing, boat racing, and dog racing, is modeled and bettors predict the order of finish of objects, such as model horses running on tracks in a race, and bet on the race. A dividend is paid to the bettors who have correctly predicted the winner, the dividend being the product of a bet amount and odds on the winner. The objects are not limited to models, and they include images displayed on a display monitor.

2. Description of the Related Art

Conventional gaming machines in which horse racing or dog racing is modeled and races are simulated have been known. In such conventional gaming machines, running objects, such as model horses by way of example, run on oval tracks, and bettors predict the winner of a particular race and bets on the race before the start of the race. As in actual horse racing or the like, the bettors can select from various bet types, such as straight, "single frame" (Japanese system of wagering in which a bettor places a bet on a frame that consists of two horses and the bettor wins the bet if one of the horses finishes first in a race), exacta, and quinella betting. In these bet types, odds (dividend rate) are displayed in accordance with each horse, each frame, or each combination thereof. Each of the bettors selects an object to place a bet on by taking into consideration risks and returns.

The betting is closed before the start of the race. The race is actually held using the running objects. A dividend is computed by multiplying a bet amount by odds for each bet, and dividends on all the bet objects are summed. The bettors who have correctly predicted the winner receive payouts.

Unlike actual horse racing or the like, in conventional gaming machines, generally a computer controls running of the running objects and sets the order of finish by drawing lots using random numbers in accordance with a predetermined strength (probability of winning) of each running object. In other words, the probability of winning of each running object is preset, and a first place finisher among all the running objects is determined in accordance with the preset probabilities of winning. A second place finisher is determined among the remaining running objects. Similarly, the order is determined until the last place finisher is determined. Therefore, the order of finish has already been set in the gaming machine prior to the start of the race or within a predetermined period of time from the start of the race. Simulated races using running objects are intended to make bettors feel the atmosphere of races and to inform the bettors of the order of finish in a particular race.

For the owner of a gaming machine, profits are the difference obtained by subtracting the total payouts from the total bet amounts placed by bettors. In order to ensure that the owner receives stable profits, the owner configures a target payout rate in advance. The probability of occurrence of each race result (such as the probability of a certain horse winning in a race) and odds set relative to the probability of winning are determined so as to statistically achieve the target payout rate. In straight betting, the probability of winning of each horse is set for each race. The quotient of the target payout rate divided by the preset probability of winning of each horse indicates the odds to be set on each horse in order to achieve the target payout rate. Table 1 shows an example of setting of the probabilities of winning and the odds.

TABLE 1

| | No. 1 | No. 2 | No. 3 | No. 4 | No. 5 | No. 6 |
|---|---|---|---|---|---|---|
| Prob. of winning (%) | 5.84 | 1.01 | 73.44 | 2.61 | 15.49 | 1.61 |
| Odds | 15.41 | 89.11 | 1.225 | 34.48 | 5.81 | 55.90 |

Table 1 indicates the probabilities of winning and the odds on horses in so-called straight betting. The first row of Table 1 indicates numbers assigned to horses. The second row indicates the probability of winning (percentage) set for each horse. The third row indicates odds set for each horse. The odds are computed so as to achieve a target payout rate of 90%.

In the description hereinafter, the probability of winning and the odds set for each horse are simply referred to as the probability of winning of each horse and the odds on each horse.

As shown in Table 1, the quotient may not be an integer depending on a combination of the target payout rate and the probability of winning. The quotient may happen to be indivisible within an appropriate number of digits. In the following description and tables, an indivisible decimal is rounded to an appropriate numeral. Actual computation is performed with an appropriate number of significant digits.

In the example shown in Table 1, when actual payouts are taken into consideration, odds which are not integers are required to be rounded to an appropriate digit. Specifically, the product of the bet amount and the odds is the payout amount. When odds with numerous decimal places are used, it is cumbersome to deliver payout amounts less than the minimum payout unit.

For example, when the minimum payout unit is a coin, it is impossible to deliver the fractional part of the payout. In general, non-integer odds are rounded up, rounded down, or rounded off so that the odds become an integer or have one decimal place. The rounded odds are then indicated to bettors.

Table 2 shows an example of rounded odds.

TABLE 2

| | No. 1 | No. 2 | No. 3 | No. 4 | No. 5 | No. 6 |
|---|---|---|---|---|---|---|
| Prob. of winning (%) | 5.84 | 1.01 | 73.44 | 2.61 | 15.49 | 1.61 |
| Odds | 15.41 | 89.11 | 1.225 | 34.48 | 5.81 | 55.90 |
| Rounded odds | 16 | 90 | 2 | 35 | 6 | 56 |
| Payout rate (%) | 93.44 | 90.9 | 146.9 | 91.35 | 92.94 | 90.16 |

When the odds are rounded, another problem occurs in that the payout rate is also changed by rounding the odds.

The fourth row of Table 2 indicates the payout rate (the expected payout rate for bettors) for each horse determined by the odds shown in Table 1.

The payout rate for each horse is computed by (probability of winning of each horse)×(odds).

In Table 2, the payout rate for horse No. 3 exceeds 100%. This means that when bets are continuously placed on horse No. 3, statistically, payouts larger than the bet amounts will always be delivered.

Although the probability of winning of each horse is an internal numeral and hence it is not easily predictable by bettors, prediction to a certain extent can be performed by statistically examining the results of many races. Since the odds are disclosed, it is possible to predict the payout rate. Therefore, when a bettor recognizes that there is a horse with a payout rate of more than 100%, the bettor will certainly place a bet on that horse.

Such settings are not favorable for the owner of a gaming machine. Depending on the country, such settings may infringe on laws concerning gaming machines.

It is possible to match the payout rate of each horse to the target payout rate by adjusting the probability of winning using rounded odds. Since the sum of the probabilities of winning must equal one, inaccurate adjustment will fail to correct the payout rates.

SUMMARY OF THE INVENTION

Accordingly, it is an object of the present invention to provide technology, in the field of gaming machines, for correcting the probability of winning and the odds on each bet so as to keep a payout rate for each bet within a predetermined range of a target payout rate even when the odds computed based on a preset probability of winning and the target payout rate are rounded.

Another object of the present invention is to provide a gaming machine and an operation method for the gaming machine to correct the probability of winning and the odds on each bet so as to keep a payout rate for each bet within a predetermined range of a target payout rate even when the odds computed based on a preset probability of winning and the target payout rate are rounded.

In order to achieve the foregoing objects, a gaming machine according to an aspect of the present invention is provided including a dividend determining unit for determining a dividend to be paid to a bettor who has won a lottery with a predetermined probability and for indicating the dividend to the bettor. The lottery includes a plurality of objects with predetermined probabilities of winning. The dividend determining unit includes a setting unit for setting a target payout rate and the probability of winning of each of the objects and for setting odds on each of the objects based on the target payout rate and the probability of winning. An ordering unit arranges the objects in order of the probability of winning. A first correction unit approximately corrects the odds on the object in the highest place to odds with a predetermined number of digits, corrects the probability of winning of the object in the highest place based on the corrected odds, reflects the difference between the uncorrected probability of winning and the corrected probability of winning of the object in the probability of winning of the object in the subsequent place, redetermines provisional odds on the object in the subsequent place based on the corrected probability of winning of the object in the subsequent place, and repetitively performs the whole processing for the objects in all places. A second correction unit approximately corrects the redetermined odds on the object in last place to odds with a predetermined number of digits, redetermines the probability of winning based on the approximated odds, and again reflects the difference between the probability of winning and the redetermined probability of winning at predetermined ratios in the probabilities of winning of all the objects.

The objects include actual objects running on tracks of the gaming machine, such as model horses to which the bettor places a bet on.

The gaming machine may further include a determining unit for determining whether a payout rate based on the corrected probabilities of winning and the corrected odds is within a predetermined allowable range of the target payout rate. When the determination by the determining unit is negative, the dividend determining unit may reset the probabilities of winning and may perform the processing again.

The second correction unit may again reflect the difference between the probability of winning and the redetermined probability of winning in the probabilities of winning of all the objects at the ratios among the probabilities of winning of the objects in all places.

In order to achieve the foregoing objects, a gaming machine according to another aspect of the present invention is provided including a dividend determining unit for determining a dividend to be paid to a bettor who has won a lottery with a predetermined probability and for indicating the dividend to the bettor. The lottery includes a plurality of objects with predetermined probabilities of winning. The dividend determining unit includes a setting unit for setting a target payout rate and the probability of winning of each of the objects and for setting odds on each of the objects based on the target payout rate and the probability of winning. An ordering unit arranges the objects in order. A first correction unit approximately corrects the odds on the object in first place to odds with a predetermined number of digits, corrects the probability of winning of the object in the first place based on the corrected odds, reflects the difference between the uncorrected probability of winning and the corrected probability of winning of the object in the probability of winning of the object in the subsequent place, redetermines the odds on the object in the subsequent place based on the corrected probability of winning of the object in the subsequent place, and repetitively performs the whole processing for the objects in all places. A second correction unit approximately corrects the redetermined odds on the object in last place to odds with a predetermined number of digits, redetermines the probability of winning based on the approximated odds, and again reflects the difference between the probability of winning and the redetermined probability of winning at predetermined ratios in the probabilities of winning of all the objects.

The ordering of the objects includes arranging the objects in an appropriate order and numbering the objects in that order. The objects can be arranged in an arbitrary order, irrespective of the values of the probabilities of winning.

In order to achieve the foregoing objects, an operation method for a gaming machine according to another aspect of the present invention is provided for determining a dividend to be paid to a bettor who has won a lottery with a predetermined probability and for indicating the dividend to the bettor. The lottery includes a plurality of objects with predetermined probabilities of winning. The operation method includes a setting step of setting a target payout rate and the probability of winning of each of the objects and setting odds on each of the objects based on the target payout rate and the probability of winning. In an rearranging step, data on the objects are rearranged in descending order of the probability of winning. In a correction step, correction processing is performed with the gaming machine. The correction processing includes the steps of approximately correcting the odds on the object with the highest probability of winning to numeric data with a predetermined number of digits; correcting the probability of winning based on the corrected odds; obtaining the difference between the uncorrected probability of winning and the corrected probability of winning; reflecting the difference in the probability of winning and in the odds on the object in the subsequent place; repetitively performing the whole processing until the object with the lowest probability of winning is processed; and allocating the difference in the probabilities of winning of the last object among the corrected probabilities of winning of the objects at predetermined ratios.

In order to achieve the foregoing objects, an operation method for a gaming machine according to another aspect of the present invention is provided for determining a dividend to be paid to a bettor who has won a bet on a lottery with a predetermined probability in straight betting and quinella betting and for indicating the dividend to the bettor. The lottery includes a plurality of objects with predetermined probabilities of winning. The operation method includes a setting step of setting a target payout rate and a probability of winning of each of straight bets and quinella bets and setting odds on each of the straight bets and the quinella bets based on the target payout rate and the probability of winning. In a first rearranging step, data on the quinella bets are rearranged in descending order of the probability of winning. In a first correction step, the odds on the quinella bet with the highest probability of winning are approximately corrected to numeric data with a predetermined number of digits, and the probability of winning is corrected based on the corrected odds. The difference between the uncorrected probability of winning and the corrected probability of winning is obtained, and the difference is reflected in the probability of winning and in the odds on the quinella bet in the subsequent place. The whole processing is repetitively performed until the quinella bet with the lowest probability of winning is corrected. The difference in the probabilities of winning of the last quinella bet is allocated in accordance with the corrected probabilities of winning of the quinella bets. In a second correction step, the corrected probabilities of winning of the quinella bets are reflected in the probabilities of winning of the straight bets, and the odds on the straight bets are redetermined. In a second rearranging step, data on the straight bets are rearranged in descending order of the probability of winning. In a third correction step, correction processing is performed with the gaming machine. The correction processing includes the steps of approximately correcting the odds on the straight bet with the highest probability of winning to numeric data with a predetermined number of digits; correcting the probability of winning based on the corrected odds; obtaining the difference between the uncorrected probability of winning and the corrected probability of winning; reflecting the difference in the probability of winning and in the odds on the straight bet in the subsequent place; repetitively performing the whole processing until the straight bet with the lowest probability of winning is corrected; and allocating the difference in the probabilities of winning of the last straight bet in accordance with the corrected probabilities of winning of the straight bets.

In straight betting, the bets include horses. In quinella betting, the bets include combinations of horses finishing in certain places.

When actual payout rates based on the corrected probabilities of winning and the corrected odds on the straight bets and the quinella bets are not within a predetermined range of the target payout rate, the probabilities of winning in straight betting and quinella betting may be reset, and the correction processing may be performed again.

In order to achieve the foregoing objects, an operation method for a gaming machine according to another aspect of the present invention is provided for determining a dividend to be paid to a bettor who has won a lottery with a predetermined probability and for indicating the dividend to the bettor. The lottery includes a plurality of objects with predetermined probabilities of winning. The operation method includes a setting step of setting a target payout rate and the probability of winning of each of the objects and setting odds on each of the objects based on the target payout rate and the probability of winning. In a rearranging step, data on the objects are rearranged in order. In a correction step, correction processing is performed with the gaming machine. The correction processing includes the steps of approximately correcting the odds on the object in first place to numeric data with a predetermined number of digits; correcting the probability of winning based on the corrected odds; obtaining the difference between the uncorrected probability of winning and the corrected probability of winning; reflecting the difference in the probability of winning and in the odds on the object in the subsequent place; repetitively performing the whole processing until the object in last place is processed; and allocating the difference in the probabilities of winning of the last object in accordance with the corrected probabilities of winning of the objects.

The ordering includes arranging the objects in an appropriate order and numbering the objects in that order. The objects can be arranged in an arbitrary order, irrespective of the values of the probabilities of winning.

The operation method may further include the steps of again performing, when bets in straight betting and quinella betting are set, the correction processing for probabilities of winning and provisional odds in quinella betting; reflecting the corrected probabilities of winning and the corrected odds in quinella betting in probabilities of winning and odds in straight betting; and redetermining provisional probabilities of winning and provisional odds in straight betting by the correction processing while maintaining the corrected odds and the corrected probabilities of winning in quinella betting.

According to the present invention, even when odds computed based on preset probabilities of winning and a preset target payout rate are rounded, the probability of winning and the odds on each bet can be corrected so as to keep a payout rate for each bet within a predetermined range of the target payout rate.

DESCRIPTION OF THE PREFERRED EMBODIMENTS

Figure 1:
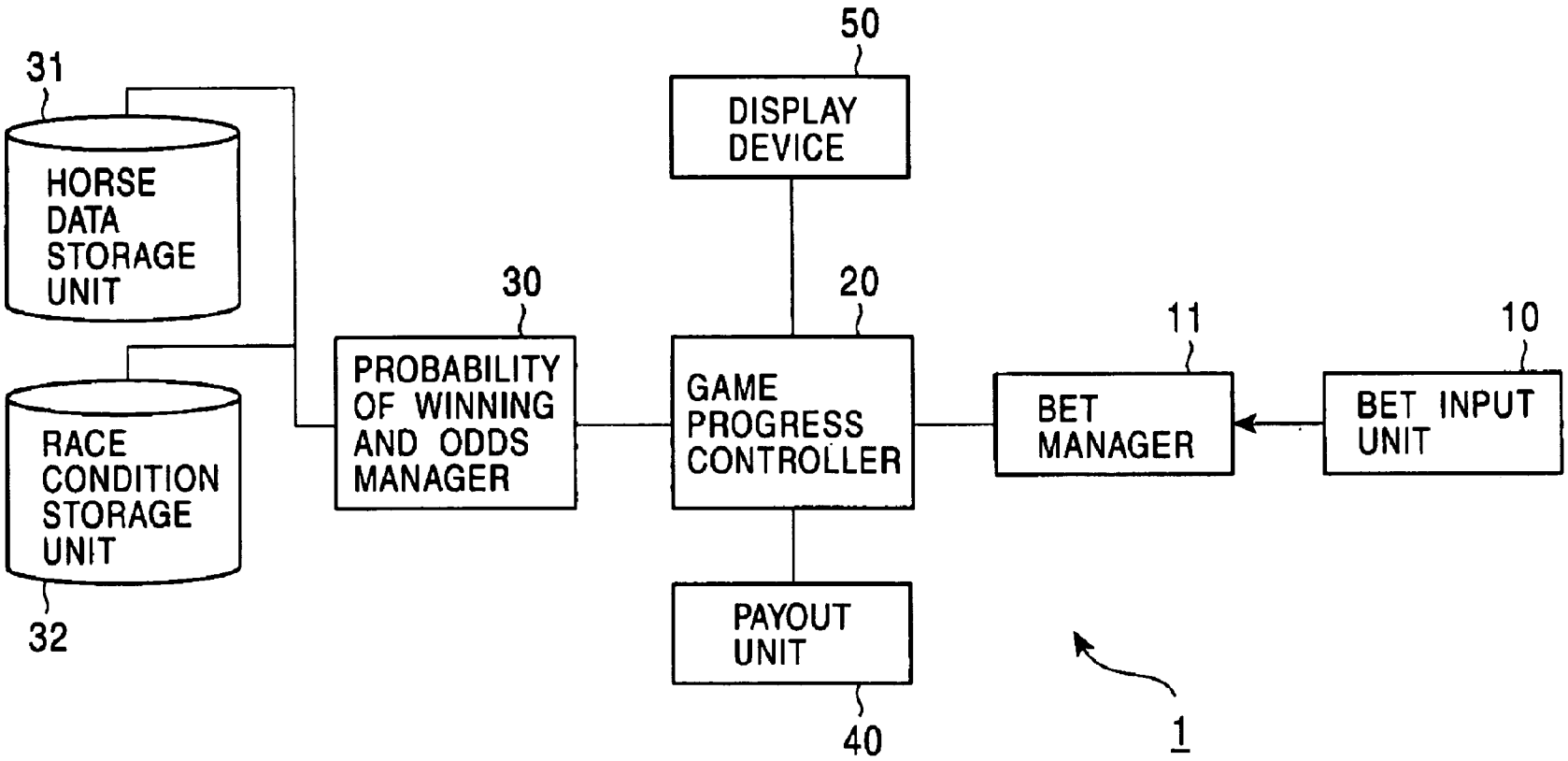
FIG. 1 is a block diagram of the structure of basic portions of a gaming machine according to an embodiment of the present invention.

The present invention will be understood from the following description of a gaming machine according to the embodiments, taken in conjunction with the accompanying drawings. In the following description, the same reference numerals are given to the same components, and repeated descriptions of the common portions are omitted.

Structure of gaming machine

FIG. 1 shows the structure of basic portions of a gaming machine according to an embodiment of the present invention. A gaming machine 1 includes model horses running on oval tracks. Bettors predict the order of finish and bet on the horses, and hence a horse racing game is performed.

The gaming machine 1 includes the following components. A bet input unit 10 accepts a bet designated by a bettor. A bet manager 11 manages the input bet. A game progress controller 20 controls the overall progress of the game. A probability of winning and odds manager 30 manages the probability of occurrence of each finishing order combination of horses in each race and the odds on all bets. A horse data storage unit 31 stores characteristic data including the names of horses and capabilities of the horses to win. A race condition storage unit 32 stores race conditions, such as the name of the actual race, the name of the racetrack, the running distance, the condition of the course, and the like. A payout unit 40 delivers a predetermined payout amount to the bettor. A display device 50 displays a simulated race in which the model horses run on the racetrack and other data concerning the race to the bettor.

The bet input unit 10, the bet manager 11, the game progress controller 20, the probability of winning and odds manager 30, the horse data storage unit 31, the race condition storage unit 32, the payout unit 40, and the display device 50 are connected to one another in the gaming machine 1, and they are configured to communicate with one another.

Figure 2:
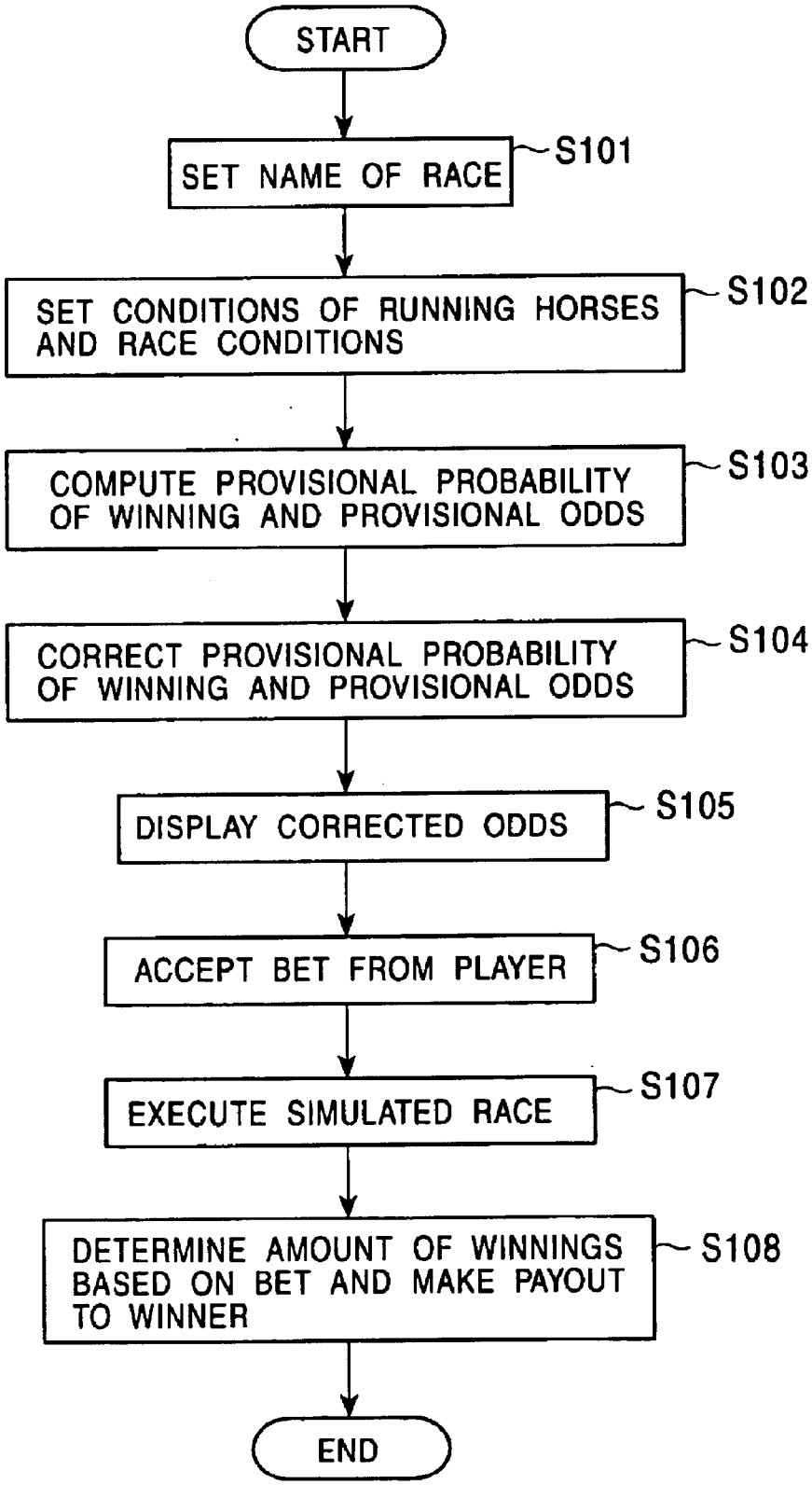
FIG. 2 is a flowchart showing the progress of a game of the gaming machine.

Referring to FIG. 2, the progress of a complete game of the gaming machine 1 is described below.

The game described below proceeds by the game progress controller 20 controlling the bet input unit 10, the bet manager 11, the probability of winning and odds manager 30, the horse data storage unit 31, the race condition storage unit 32, the payout unit 40, and the display device 50. FIG. 2 shows a process of the overall progress of the game of the gaming machine 1.

The process sets a name for the subsequent race (step S101). The name of the race can be the name of an actual horse race, such as the Derby. The name can also be an associated name or a fictitious name, such as the Konami Classics.

After the name of the race has been set, the process sets the conditions of horses running in the race and the race conditions (step S102). The running horses are appropriately selected from a plurality of horses (data) stored in the horse data storage unit 31. It is also possible to use a list of horses selected in advance according to each race. For the race conditions, data simulating the race conditions of a racetrack in which an actual race is held can be used, including the running distance, the condition of the course, the rising and falling of the course, and the running direction of the course. Alternatively, it is possible to use data appropriately set for a fictitious race. The race conditions are stored in the race condition storage unit 32.

Based on the characteristic data on each running horse and the race conditions, the process computes a provisional probability of winning of each horse running in the race. The sum of all the probabilities of winning of all the horses must equal one.

At the same time, a target payout rate is read from the race condition storage unit 32. The payout rate is divided by the probability of winning of each running horse, thus obtaining provisional odds on the running horse (step S103).

At this point, the process determines whether to configure only one bet type, that is, straight betting, or a plurality of bet types, that is, straight betting and quinella betting. In the case of configuring a plurality of bet types, the provisional probabilities of winning and odds are computed for straight betting and quinella betting.

The probabilities of winning and the odds are corrected by a method described below. In the method, in order that an actual payout rate is maintained within a predetermined range of the target payout rate, the odds are rounded to an appropriate digit and the probabilities of winning are corrected based on the rounded odds (step S104).

After correcting the odds and the probabilities of winning, the list of running horses and the final odds on each horse are displayed to the bettor (step S105). As a matter of course, the probability of winning of each horse is not displayed.

After the odds are indicated, a bet placed by the bettor is accepted through the bet input unit 10 (step S106). The bet input by the bettor is stored in the bet manager 11.

Subsequently, the display device 50 displays a simulated race and the order of finish to the bettor (step S107). The process determines who has won the bet on the race, and delivers a payout to the bettor (step S108). Accordingly, the race is terminated.

In the gaming machine 1 with the above configuration, the correction method for correcting the odds and the probabilities of winning is described below.

Correction processing by the correction method is performed by the probability of winning and odds manager 30 in step S104.

Correction method in straight betting

The case in which only one type of betting, that is, straight betting, is employed is described. In this description, straight betting means that a bettor correctly selects a horse to win (finish in first place).

Assuming that n is the number of horses running in a race, the probability of winning W of each horse is expressed as:

$$Wi\ \{Wi>0,\ W1+W2+W3+W4+\ldots\ Wn=1\}$$

$$(\text{where } i=1, 2, 3, 4, \ldots, n) \quad (1)$$

Assuming that $P_o$ is the target payout rate, the provisional odds Oi on each running horse and the payout rate Ri for that running horse are expressed as:

$$Oi=P_o+Wi,\ Ri=O\times Wi\ (\text{where } i=1, 2, \ldots, n) \quad (2)$$

When rounding the odds to an appropriate digit, the rounded odds are a value obtained by adding an error Di to the odds Oi. The payout rate R'i for each horse based on the rounded odds is expressed as:

$$R'i=(Oi+Di)\times Wi=Oi\times Wi+Di\times Wi=Ri+(Di\times Wi) \quad (3)$$

As shown in equation (3), the error Di×Wi occurs in the actual payout rate R'i for each running horse. The higher the probability of winning, the larger the error. Therefore, the odds and the probability of winning are corrected in order to minimize the error in the payout rate.

Figure 3:
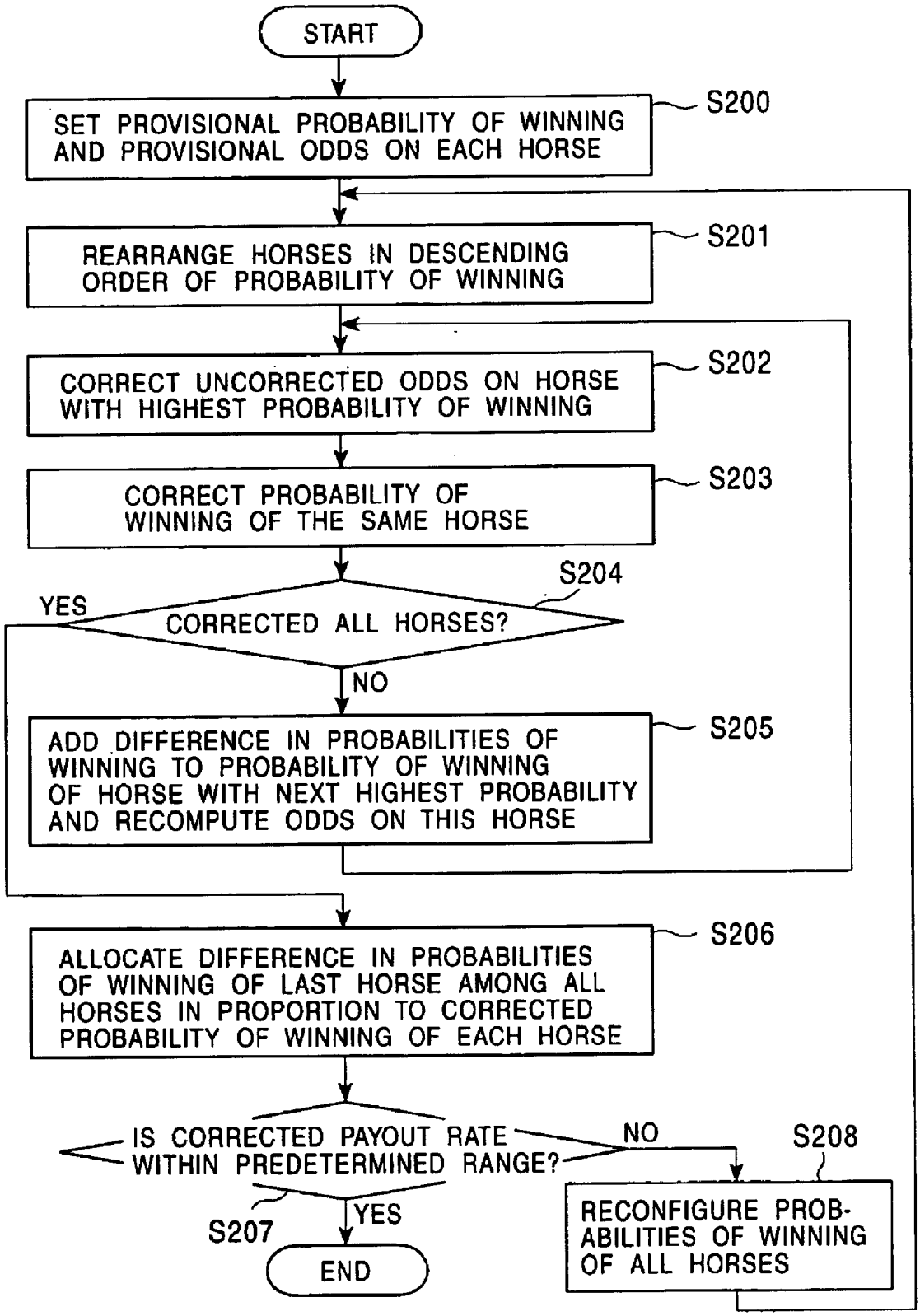
FIG. 3 is a flowchart showing a process for correcting probabilities of winning and odds in straight betting.

FIG. 3 shows a process for correcting the probabilities of winning and the odds in straight betting.

(Step 1)

The process provisionally sets the probability of winning and the odds on each running horse (step S200). The process rearranges all the horses in an appropriate order (step S201). In the present embodiment, the horses are rearranged in descending order of probability of winning. The provisional probabilities of winning of the rearranged horses are expressed as Wk[i] (where i=1, 2, 3, . . . , n), and the provisional odds are expressed as Ok[i] (where i=1, 2, 3, . . . , n) in which k[i] indicates a number assigned to each of the rearranged horses.

(Step 2)

The provisional odds on a horse with the highest probability of winning Wi are rounded to an appropriate digit (step S202). In the present embodiment, one decimal place is rounded up. The rounded odds O'k[1] are expressed as:

$$O'k[1]=Ok[1]+Dk[1]$$

(where Dk[1] is the error caused by rounding) (4)

(Step 3)

The provisional probability of winning is corrected using the rounded odds (step S203).

$$W'k[1]=Po+O'k[1] \quad (5)$$

The difference between the corrected probability of winning W'k[1] and the original probability of winning Wk[1] is Xk[1], and Xk[1] can be expressed as:

$$Xk[1]=1-(W'k[1]+Wk[2]+Wk[3]+\ldots+Wk[n]) \quad (6)$$

(Step 4)

The difference Xk[1] is added to the probability of winning of a horse with the second highest probability of winning, and hence the sum becomes Wk[2]+Xk[1]. The odds on the second horse are recomputed (step S205). The recomputed odds are rounded, thus obtaining the corrected probability of winning of the second hores as:

$$O'k[2]=Po+(Wk[2]+Xk[1])+Dk[2]$$

(where Dk[2] is the error caused by rounding) (7)

(Step 5)

The probability of winning of the second horse is corrected again based on the corrected odds (step S203).

$$W'k[2]=Po+O'k[2] \quad (8)$$

The difference Xk[2] concerning the corrected probability of winning W'k[2] can be expressed as:

$$Xk[2]=1-(W'k[1]+W'k[2]+Wk[3]+\ldots+Wk[n]) \quad (9)$$

(Step 6)

From this point onward, correction is repetitively performed on a third horse to a horse with the smallest probability of winning (steps S202 to S205). The corrected odds, the corrected probability of winning, and the difference in the probabilities of winning of each horse are expressed as:

$$O'k[i]=P_o+(Wk[i]+Xk[i-1])+Dk[i]$$

(where Dk[i] is the error caused by rounding)

$$W'k[i]=P_{o+O'k[i]}$$

$$Xk[i]=1-(W'k[1]+W'k[2]+W'k[3]+\ldots W'k[i]+Wk[i+1]+\ldots+Wk[n]) \quad (10)$$

(Step 7)

The difference in the probabilities of winning of the last horse is Xk[n], and Xk[n] is allocated among all the horses in proportion to the probability of winning of each horse. Hence, the final probability of winning W"i of each horse is obtained (step S206). A finally corrected payout rate R"i for each horse is expressed as:

$$R''i=O'i\times W''i \quad (11)$$

(Step 8)

If the payout rate for each horse is not kept within a predetermined range of a target payout rate, a provisional probability of winning of each horse is again set (step S208), and processing from Step 1 to Step 7 is repeated based on the reconfigured provisional probabilities of winning (step S207).

An application of the correction method is described in detail using specific numbers. A target payout rate $P_o$ is set to 85%, the number of horses n running in a race is set to four, and the provisional probabilities of winning of the horses are set to 0.5, 0.32, 0.11, and 0.07, respectively. Accordingly, the provisional odds on each horse are set as shown in Table 3.

TABLE 3

| | No. 1 | No. 2 | No. 3 | No. 4 |
|---|---|---|---|---|
| Prob. of winning | 0.5 | 0.32 | 0.11 | 0.07 |
| Odds | 1.7 | 2.65625 | 7.727273 | 12.142858 |

The probability of winning and the odds on horse No. 1 are corrected. The odds 1.7 are rounded up to 2, and the probability of winning becomes 0.85÷2=0.425, as shown in Table 4.

TABLE 4

| | No. 1 | No. 2 | No. 3 | No. 4 |
|---|---|---|---|---|
| Prob. of winning | 0.425 | 0.32 | 0.11 | 0.07 |
| Odds | 2 | 2.65625 | 7.727273 | 12.142858 |

The difference between the provisional probability of winning and the corrected probability of winning is 0.075. The difference 0.075 is added to the probability of winning of horse No. 2, thus obtaining 0.395. The odds on horse No. 2 are recomputed as 0.85+0.395=2.151899. The recomputed odds are rounded to 3. The probability of winning is recomputed as 0.85+3=0.283333, as shown in Table 5.

TABLE 5

| | No. 1 | No. 2 | No. 3 | No. 4 |
|---|---|---|---|---|
| Prob. of winning | 0.425 | 0.283333 | 0.11 | 0.07 |
| Odds | 2 | 3 | 7.727273 | 12.142858 |

The difference in the probabilities of winning of horse No. 2 is 0.111667. Similarly, the difference 0.111667 is added to the probability of winning of horse No. 3, thus obtaining 0.221667. The odds are recomputed as 0.85÷0.221667=3.834586. Similarly, the recomputed odds are rounded to 4. The probability of winning is recomputed as 0.85+4=0.2125, as shown in Table 6.

TABLE 6

| | No. 1 | No. 2 | No. 3 | No. 4 |
|---|---|---|---|---|
| Prob. of winning | 0.425 | 0.283333 | 0.2125 | 0.07 |
| Odds | 2 | 3 | 4 | 12.142858 |

The difference in the probabilities of winning of horse No. 3 is 0.009167. Similarly, the difference 0.009167 is added to the probability of winning of horse No. 4, thus obtaining 0.079167. The odds on horse No. 4 are recomputed as 0.85+0.079167=10.736842. The recomputed odds are rounded to 11. The probability of winning is recomputed as 0.85+11=0.077273, as shown in Table 7.

TABLE 7

| | No. 1 | No. 2 | No. 3 | No. 4 |
|---|---|---|---|---|
| Prob. of winning | 0.425 | 0.283333 | 0.2125 | 0.077273 |
| Odds | 2 | 3 | 4 | 11 |

The difference in the probabilities of winning of the last horse No. 4 is 0.001894. The difference 0.001894 is allocated among all the horses in proportion to the corrected probabilities of winning, respectively. The finally corrected probabilities of winning, the odds, and the payout rates are expressed as shown in Table 8.

TABLE 8

| | No. 1 | No. 2 | No. 3 | No. 4 |
|---|---|---|---|---|
| Prob. of winning | 0.425806 | 0.283871 | 0.212903 | 0.0774194 |
| Odds | 2 | 3 | 4 | 11 |
| Payout rate | 0.851613 | 0.851613 | 0.851613 | 0.851613 |

Accordingly, the payout rates for the horses are averaged out. In other words, according to the corrected payout rates, the bettor can expect substantially the same payout rate irrespective of which horse the bettor has placed a bet on, and the owner of the gaming machine can make stable profits.

Correction method in straight betting and complex betting The case in which bet types including straight betting and complex betting are used is described next. Complex betting includes exacta and quinella. In exacta, the first and second place finishers must be designated in the exact order. For example, when a bettor predicts that horse No. 1 will finish in first place (win) and horse No. 2 will finish in second place (place), the bettor places a bet on 1-2. In quinella, the first and second place finishers in either order are selected. For example, when the bettor predicts that horse No. 2 and horse No. 3 will finish in the first two places, the bettor places a bet on 2-3, without reference to the order of their finish. In the following description, the probability of winning and the odds in exacta or quinella betting indicate the probability of winning and the odds set on each combination of horses, such as 1-2, 2-3, or the like, forming each bet.

Assuming that n is the number of horses running in a race, the probability of winning of each horse is expressed as expression (1). In exacta, the probability of winning WEij that horse No. i will win the race and horse No. j will place is expressed as:

$$WEij=Wi\times Wj+(1-Wi) \tag{12}$$

In quinella, the probability of winning WQij that horse No. i and horse No. j will finish the race in the first two places is expressed as:

$$WQij=WEij+WEji \text{ (wherein } WQij=WQji) \tag{13}$$

In quinella, the odds OQij that horse No. i and horse No. j will finish the race in the first two places are expressed as:

$$OQij=P_o+WQij \text{ (wherein } OQij=OQji) \tag{14}$$

Figure 4:
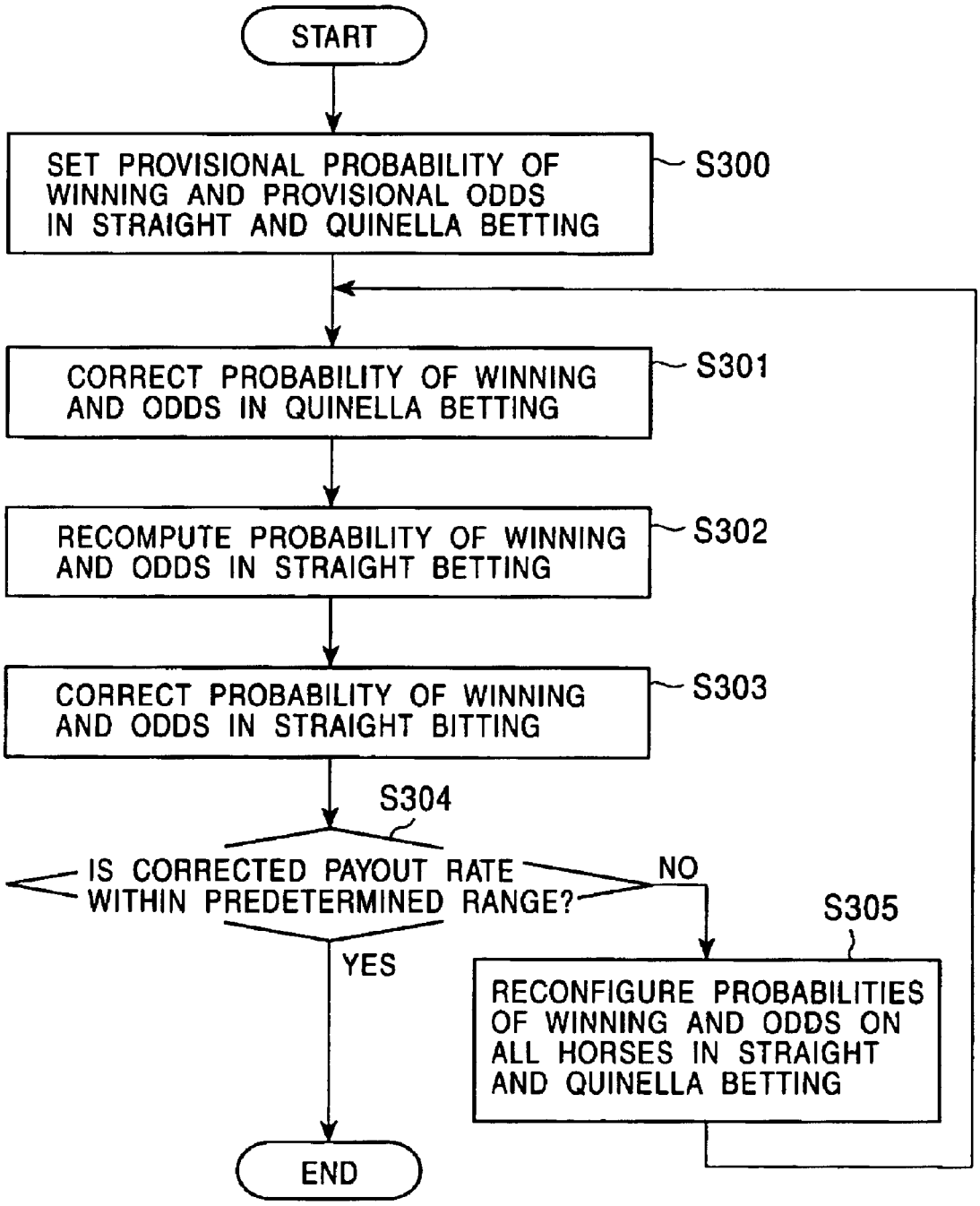
FIG. 4 is a flowchart showing a process for correcting probabilities of winning and odds in straight betting and quinella betting.

FIG. 4 shows a process for performing correction processing for two bet types, i.e., straight betting and quinella betting. Although it is assumed that straight betting and quinella betting are used in the present embodiment, a process for computing the probability of winning in exacta betting is indicated for reference. For each bet in straight betting and quinella betting, the probability of winning and the odds are provisionally set (step S300). The provisional probability of winning and the provisional odds are corrected as follows.

A. Correct odds and probabilities of winning in quinella betting (step S301).

B. Recompute odds and probabilities of winning in straight betting using corrected probabilities of winning in quinella betting (step S302).

C. Correct odds and probabilities of winning in straight betting without changing probabilities of winning and odds in quinella betting (Step S303).

If each of the resultant payout rates for all bets in straight betting and quinella betting is not kept within a predetermined range of a target payout rate, provisional probabilities of winning are reconfigured in straight betting and quinella betting. Processing from steps S301 to S303 is repeated based on the reconfigured provisional probabilities of winning.

Hereinafter steps in the process for correcting the provisional probabilities of winning and the provisional odds are described.

A. Correcting odds and probabilities of winning in quinella betting

A-1. Quinella bets are appropriately rearranged, for example, in descending order of probability of winning. In the present embodiment, the quinella bets are rearranged in order of numerical combinations, that is, in order of 1-2, 1-3, 1-4, 2-3, 2-4, and 3-4. The provisional probability of winning of each of the rearranged quinella bets is expressed as WQk[i] (where i=1, 2, 3, . . . , n), and the provisional odds are expressed as OQk[i] (where i=1, 2, 3, . . . , n), in which k[i] indicates a combination of the rearranged horses in quinella betting:

$$WQk[1]\geqq WQk[2]\geqq \ldots \geqq WQk[m]$$

$$\text{(where } m=n\times(n-1)+2) \tag{15}$$

A-2. The odds on the first quinella bet are corrected. In the present embodiment, correction is performed by rounding up, where OQ'k[1] is the corrected odds:

$$OQ'k[1]=OQk[1]+DQk[1]$$

$$\text{(where DQk[1] is the error caused by rounding)} \tag{16}$$

A-3. The probability of winning is corrected based on the corrected odds, where XQk[1] is the difference in the probabilities of winning:

$$WQ'k[1]=P_o+OW'k[1],$$

$$XQk[1]=1-(WQ'k[1]+WQk[2]+\ldots+WQk[m]) \tag{17}$$

A-4. The difference XQk[1] is added to the probability of winning of the second bet. Subsequently, the odds on the second bet are recomputed and corrected as:

$$OQ'k[2]=P_o+(WQk[2]+XQk[1])+DQk[2] \tag{18}$$

A-5. The probability of winning is corrected based on the corrected odds, where XQk[2] is the difference in the probabilities of winning:

$$WQ'k[2]=P_o+OQ'k[2],$$

$$XQk[2]1-(WQ'k[1]+WQ'k[2]+WQk[3]+\ldots+WQk[m]) \tag{19}$$

A-6. From this point onward, correction is repeated until the last bet is corrected. The corrected odds, the corrected probability of winning, and the difference in the probabilities of winning of the m-th bet are expressed as:

$$OQ'k[m]=P_o+(WQk[m]+XQk[m-1])+DQk[m],$$

$$WQ'k[m]=P_o+OQ'k[m],$$

$$XQk[m]=1-(WQ'k[1]+WQ'k[2]+WQ'k[3]+\ldots+WQ'k[m]) \quad (20)$$

A-7. The difference in the probabilities of winning of the last bet, which is XQk[m] (hereinafter expressed as XQ), is allocated among all horses in proportion to the corrected probability of winning WQ'i of each horse, thereby correcting the probability of winning of each horse to a final probability of winning WQ"i:

$$WQ''i=WQ'i+XQ\times WQ'i+(1-XQ)$$

(where i=1, 2, . . . , m) (21)

A payout rate RQ"i for each combination in quinella betting is expressed as:

$$RQ''i=OQ'i\times WQ''i \quad (22)$$

B. Recomputing odds and probabilities of winning in straight betting

B-1. The probability of winning WE'ij of each exacta bet is recomputed:

$$WE'ij=WQij\times WEij+(WEij+WEji)$$

(where i=1, 2, . . . , n; j=1, 2, . . . , n; and i≠j)

(where WQij is the corrected probability of winning in quinella betting and WEij is the uncorrected probability of winning in exacta betting) (23)

B-2. The probability of winning W'i in straight betting is recomputed:

$$W'i=WE'i+WE'i2+\ldots+WE'in$$

(where i=1, 2, . . . n and WE'ii=0) (24)

B-3. The odds O'i in straight betting are recomputed:

$$O'i=P_o+W'i \text{ (where } i=1, 2, \ldots, n) \quad (25)$$

C. Correcting odds and probabilities of winning in straight betting

C-1. Straight bets (horses) are rearranged in an appropriate order. In the present embodiment, the straight bets are rearranged in descending order of probability of winning. The provisional probability of winning (which is recomputed by the processing in B) of each of the rearranged straight bets is expressed as W'k[i] (where i=1, 2, 3, . . . , n), and the provisional odds are expressed as O'k[i] (where i=1, 2, 3, . . . , n), in which k[i] indicates the number of each of the rearranged horses.

C-2-1. The odds on the straight bet with the highest probability of winning are corrected. In the present embodiment, correction is performed by rounding up, where O"k[1] is the corrected odds:

$$O''k[1]=O'k[1]+Dk[1]$$

(where Dk[1] is the error caused by rounding) (26)

C-2-2. The probability of winning is corrected based on the corrected odds, where Xk[1] is the difference in the probabilities of winning:

$$W''k[1]=P_o+O''k[1],$$

$$Xk[1]=1-(W''k[1]+Wk[2]+\ldots+Wk[n]) \quad (27)$$

C-2-3. The difference in the probabilities of winning is Xk[1], and Xk[1] is allocated among the probabilities of winning in exacta betting, that is, k[2]–k[1], k[3]–k[1], . . . , and k[n]–k[1], at ratios among the probabilities of winning in exacta betting, that is, k[1]–k[2], k[1]–k[3], . . . , and k[1]–k[n]:

$$WE''k[i]k[1]WE'k[i]k[1]+Xk[1]\times WE'k[1]k[i]+(WE'k[1]k[2]+WE'k[i]k[3]+\ldots+WE'k[1]k[n])$$

(where i=2, 3, . . . , n) (28)

C-2-4. The increases in the probabilities of winning in exacta betting are subtracted from k[1]–k[2], k[1]–k[3], . . . , and k[1]–k[n], respectively, in order not to change the probabilities of winning in quinella betting:

$$WE''k[1]k[i]=WE'k[1]k[i]-Xk[1]\times WE'k[1]k[i]+(WE'k[1]k[2]+WE'k[1]k[3]+\ldots+WE'k[1]k[n])$$

(where i=2, 3, . . . , n) (29)

C-2-5. The probabilities of winning and the odds on No. k[2], No. k[3], . . . , and No. [n] in straight betting are recomputed as:

$$W''k[i]=WE''k[i]k[1]+WE'k[i]k[2]++WE'k[i]k[n]$$

$$O''k[1]=P_oW''k[i]$$

(where $i$=2, 3, . . . , $n$ and $WE'k[i]k[i]$=0) (30)

C-3. Hereinafter the odds and the probabilities of winning are corrected until the straight bet with the (n−1)th highest probability of winning is corrected.

C-3-1. The corrected odds on the straight bet with the i-th highest probability of winning are expressed as O"k[i]:

$$O''k[i]=O'k[i]+Dk[i]$$

(where Dk[i] is the error caused by rounding) (31)

C-3-2. The probability of winning is corrected based on the corrected odds, where Xk[i] is the difference in the probabilities of winning:

$$W''k[i]=P_o+O''k\,[i]$$

$$Xk[i]=1-(W''k[1]+W''k[2]+\ldots+W''k[i]+W'k[i+]+\ldots+W'k[n]) \quad (32)$$

C-3-3. The difference in the probabilities of winning is Xk[i], and Xk[i] is allocated among the probabilities of winning in exacta betting as:

$$WE''k[j]k[i]=WE'k[j]k[i]+Xk[i]\times F(i,j)+(F(i,1)+F(i,2)+\ldots+F(i,n))$$

(where $i$=2, 3, . . . , $n$−1; $j$=1, 2, . . . , $n$; and $i\neq j$ $F(a,b)=WE'k[a][b]$ (when $b>a$)

$F(a,b)=WE'k[b][a+1]$ (when $b<a$)

$F(a,b)=0$ (when $a=b$)) (33)

C-3-4. The probabilities of winning in exacta betting are corrected in order not to change the probabilities of winning in quinella betting:

$$WE''k[i]k[j]=WE'k[j]k[i]-Xk[i]\times F(i,j)+(F(i,1)+F(i,2)+\ldots+F(i,n))$$

(where $i$=2, 3, . . . , $n$−1$i$; $j$=1, 2, . . . , $n$; and $i\neq j$ $F(a,b)=WE'k[a][b]$ (when $b>a$)

$$F(a,b)=WE'k[b][a+1] \text{ (when } b<a)$$

$$F(a,b)=0 \text{ (when } a=b)) \quad (34)$$

C-3-5. The probabilities of winning in exacta betting are corrected in order not to change the probabilities of winning of the straight bets ranging from the bet with the highest probability of winning to the bet with the (i−1)th highest probability of winning:

$$WE''k[j]k[i+1]=WE'k[j]k[i+1]-Xk[i]\times F(i,j)+(F(i,1)+F(i,2)+\ldots+F(i,n))$$

$$WE''k[i+1]k[j]=WE'k[i+1]k[j]+Xk[i]\times F(i,j)+(F(i,1)+F(i,2)+\ldots+F(i,n))$$

$$\text{(where } i=2,3,\ldots,n-1;\ j=1,2,\ldots,n;\text{ and } j<i \quad (35)$$

$$F(a,b)=WE'k[a][b] \text{ (when } b>a)$$
$$F(a,b)=WE'k[b][a+1] \text{ (when } b<a)$$
$$F(a,b)=0 \text{ (when } a=b))$$

C-3-6. The probabilities of winning and the odds on the straight bets ranging from the bet with the (i+1)th highest probability of winning to the bet with the n-th highest probability of winning are recomputed as in C-2-5.

C-4-1. The odds on the straight bet on the horse with the lowest probability of winning (i=n) are corrected by rounding up, where O"k[n] is the corrected odds:

$$O''k[n]=O'k[n]+Dk[n]$$

(where Dk[n] is the error caused by rounding) (36)

C-4-2. The probability of winning is corrected based on the corrected odds, where Xk[n] is the difference in the probabilities of winning:

$$W''k[n]=P_o+O''k[n]$$

$$Xk[n]=1-(W''k[1]+W''k[2]+\ldots+W''k[n])$$

$$(W''k[n]=WE''k[n]k[1]+WE''k[n]k[2]+\ldots+WE''k[n]k[n-1]-Xk[n]) \quad (37)$$

C-4-3. The difference in the probabilities of winning of the last horse, which is Xk[n] (hereinafter expressed as X), is allocated among the probabilities of winning in exacta betting as:

$$WE'''k[i]k[n]=WE''k[i]k[n]+X\times W''k[i]+(1\times X)$$

(where i=1, 2, . . . , n−1)

$$WE'''k[n]k[i]=WE''k[n]k[i]-X\times W''k[i]+(1-X)$$

(where i=1, 2, . . . , n−1) (38)

C-4-4. The probabilities of winning in straight betting are recomputed as follows.

If i=1, 2, . . . , n−1, then $$WE'''k[i]=WE''k[i]k[1]+WE''k[i]k[2]+\ldots+WE''k[i]k[n-1]+WE'''k[i]k[n] \text{ (where } WE''ii=0)$$

$$=WE''k[i]k[1]+WE''k[i]k[2]+\ldots+WE''k[i]k[n-1]+WE''k[i]k[n]+X\times W''k[i]+(1-X)$$

$$=W''k[i]+X\times W''k[i]+(1-X) \quad (39)$$

If i=n, then $$W'''k[i]=WE'''k[i]k[1]+WE'''k[i]k[2]+\ldots+WE'''k[i]k[i-1]$$

$$=\{WE''k[i]k[1]-X\times W''k[1]+(1-X)\}+\{WE''k[i]k[2]-X\times W''k[2]+(1-X)\}+\ldots+\{WE''k[i]k[i-1]-X\times W''k[i-1]+(1-X)\}=WE''k[i]k[1]+WE''k[i]k[2]+\ldots+WE''k[i]k[i-1]-X+(1-X)\times(W''k[1]+W''k[2]+\ldots+W''k[i-1])$$

$$=WE''k[i]k[1]+WE''k[i]k[2]+\ldots+WE''k[i]k[i-1]-X+(1-X)\times(1-X-W''k[i])=WE''k[i]k[1]+WE''k[i]k[2]+\ldots+WE''k[i]k[i-1]-X+X\times W''k[i]+(1-X)=W''k[i]+X\times W''k[i]+(1-X) \quad (40)$$

A payout rate R"i for each horse in straight betting is expressed as:

$$R''i=O''i\times W'''i \quad (41)$$

An application of the correction method is described in detail using specific numbers. The target payout rate $P_o$ is set to 90%, the number of horses n running in the race is set to four, and the provisional probabilities of winning of straight bets (horses) are set to 0.5, 0.32, 0.13, and 0.05, respectively. The probabilities of winning and the odds in straight betting, the probabilities of winning in exacta betting, and the probabilities of winning and the odds in quinella betting are shown in Table 9. Tables 9 to 26 each include four tables, that is, an upper-left table showing the probabilities of winning and the odds in straight betting, an upper-right table showing the probabilities of winning in exacta betting, a lower-left table showing the probabilities of winning in quinella betting, and a lower-right table showing the odds in quinella betting.

TABLE 9

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.047816 | | 0.007471 |
| 4− | 0.026316 | 0.016842 | 0.006842 | |

| 1st, 2nd place | −2 | −3 | −4 |
|---|---|---|---|
| 1− | 0.555294 | 0.204713 | 0.076316 |
| 2− | | 0.108993 | 0.040372 |
| 3− | | | 0.014313 |

| 1st, 2nd place | −2 | −3 | −4 |
|---|---|---|---|
| 1− | 1.620763 | 4.396047 | 11.793103 |
| 2− | | 8.257444 | 22.292945 |
| 3− | | | 62.8783 |

The odds and the probability of winning of "1-2" in quinella betting are corrected. The odds 1.620763 are rounded up to 2, and hence the probability of winning becomes 0.9+2=0.45. The difference in the probabilities of winning of "1-2" in quinella betting is 0.105294, and 0.105294 is added to the probability of winning of "1-3" in quinella betting, thus obtaining 0.310007. The odds are recomputed, and hence 0.9+0.310007=2.903162, as shown in Table 10.

TABLE 10

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.47816 | | 0.007471 |
| 4− | 0.026316 | 0.016842 | 0.006842 | |

| 1st, 2nd place | −2 | −3 | −4 |
|---|---|---|---|
| 1− | 0.45 | 0.310007 | 0.076316 |
| 2− | | 0.108993 | 0.040372 |
| 3− | | | 0.014313 |

| 1st, 2nd place | −2 | −3 | −4 |
|---|---|---|---|
| 1− | 2 | 2.903162 | 11.793103 |
| 2− | | 8.257444 | 22.292945 |
| 3− | | | 62.878276 |

The odds and the probability of winning of "1-3" in quinella betting are corrected next. The odds 2.903162 are rounded up to 3, and hence the probability of winning becomes 0.9+3=0.3. Similarly, the difference in the probabilities of winning of "1-3" in quinella betting is 0.010007, and 0.010007 is added to the probability of winning of "1-4" in quinella betting, thus obtaining 0.086323. The odds are recomputed, and hence 0.9+0.086323 =10.426013, as shown in Table 11.

TABLE 11

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.047816 | | 0.007471 |
| 4− | 0.026316 | 0.016842 | 0.006842 | |

| 1st, 2nd place | −2 | −3 | −4 |
|---|---|---|---|
| 1− | 0.45 | 0.3 | 0.086323 |
| 2− | | 0.108993 | 0.040372 |
| 3− | | | 0.014313 |

| 1st, 2nd place | −2 | −3 | −4 |
|---|---|---|---|
| 1− | 2 | 3 | 10.426013 |
| 2− | | 8.257444 | 22.292945 |
| 3− | | | 62.878276 |

The odds and the probability of winning of "1-4" in quinella betting are corrected next. The odds 10.426013 are rounded up to 11, and hence the probability of winning becomes 0.9+11=0.081818. Similarly, the difference in the probabilities of winning of "1-4" in quinella betting is 0.004504, and 0.004504 is added to the probability of winning of "2-3" in quinella betting, thus obtaining 0.113497. The odds are recomputed, and hence 0.9+0.113497 =7.92973, as shown in Table 12.

TABLE 12

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.047816 | | 0.007471 |
| 4− | 0.026316 | 0.016842 | 0.006842 | |

| 1st, 2nd place | −2 | −3 | −4 |
|---|---|---|---|
| 1− | 0.45 | 0.3 | 0.081818 |
| 2− | | 0.113497 | 0.040372 |
| 3− | | | 0.014313 |

| 1st, 2nd place | −2 | −3 | −4 |
|---|---|---|---|
| 1− | 2 | 3 | 11 |
| 2− | | 7.92973 | 22.292945 |
| 3− | | | 62.878276 |

The odds and the probability of winning of "2-3" in quinella betting are corrected next. The odds 7.92973 are rounded up to 8, and hence the probability of winning becomes 0.9+8=0.1125. Similarly, the difference in the probabilities of winning of "2-3" in quinella betting is 0.000997, and 0.000997 is added to the probability of winning of "2-4" in quinella betting, thus obtaining 0.041368. The odds are recomputed, and hence 0.9+34 0.041368 =21.755711, as shown in Table 13.

TABLE 13

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 16 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.047816 | | 0.007471 |
| 4− | 0.026316 | 0.016842 | 0.006842 | |

| 1st, 2nd place | −2 | −3 | −4 |
|---|---|---|---|
| 1− | 0.45 | 0.3 | 0.081818 |
| 2− | | 0.1125 | 0.041368 |
| 3− | | | 0.014313 |

| 1st, 2nd place | −2 | −3 | −4 |
|---|---|---|---|
| 1− | 2 | 3 | 11 |
| 2− | | 8 | 21.755711 |
| 3− | | | 62.878276 |

The odds and the probability of winning of "2-4" in quinella betting are corrected next. The odds 21.755711 are rounded up to 22, and hence the probability of winning becomes 0.9+22=0.040909. Similarly, the difference in the probabilities of winning of "2-4" in quinella betting is 0.000459, and 0.000459 is added to the probability of winning of "3-4" in quinella betting, thus obtaining 0.014773. The odds are recomputed, and hence 0.9+ 0.014773 =60.923077, as shown in Table 14.

TABLE 14

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.047816 | | 0.007471 |
| 4− | 0.026316 | 0.016842 | 0.006842 | |

| 1st, 2nd place | −2 | −3 | −4 |
|---|---|---|---|
| 1− | 0.45 | 0.3 | 0.081818 |
| 2− | | 0.1125 | 0.040909 |
| 3− | | | 0.014773 |

| 1st, 2nd place | −2 | −3 | −4 |
|---|---|---|---|
| 1− | 2 | 3 | 11 |
| 2− | | 8 | 22 |
| 3− | | | 60.923077 |

The odds and the probability of winning of "3-4" in quinella betting are corrected next. The odds 60.923077 are rounded up to 61, and hence the probability of winning becomes 0.9+61=0.014754, as shown in Table 15.

TABLE 15

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.047816 | | 0.007471 |
| 4− | 0.026316 | 0.016842 | 0.006842 | |

| 1st, 2nd place | −2 | −3 | −4 |
|---|---|---|---|
| 1− | 0.45 | 0.3 | 0.081818 |
| 2− | | 0.1125 | 0.040909 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The difference in the probabilities of winning of "3-4" in quinella betting is 0.000019. The difference 0.000019 is allocated among quinella bets in proportion to the probabilities of winning of the quinella bets, and the allocated portions are added to the respective probabilities of winning. Hence, the finally corrected probabilities of winning and the odds on the quinella bets are shown in Table 16.

TABLE 16

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.32 | 0.13 | 0.05 |
| 2− | 0.235294 | | 0.061176 | 0.023529 |
| 3− | 0.074713 | 0.047816 | | 0.007471 |
| 4− | 0.026316 | 0.016842 | 0.006842 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

Using equation (23), the probabilities of winning in exacta betting are computed based on the corrected probabilities of winning of the quinella bets, as shown in Table 17.

TABLE 17

| | Prob. of winning | Odds |
|---|---|---|
| No. 1 | 0.5 | 1.8 |
| No. 2 | 0.32 | 2.8125 |
| No. 3 | 0.13 | 6.923077 |
| No. 4 | 0.05 | 18 |

| | 2nd place | | | |
|---|---|---|---|---|
| 1st place | −1 | −2 | −3 | −4 |
| 1− | | 0.259327 | 0.190514 | 0.053606 |
| 2− | 0.190682 | | 0.063146 | 0.023843 |
| 3− | 0.109491 | 0.049356 | | 0.007701 |
| 4− | 0.028214 | 0.017067 | 0.007053 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

Using equations (24) and (25), the probabilities of winning and the odds in straight betting are computed based on the corrected probabilities of winning in exacta betting, as shown in Table 18.

TABLE 18

| | Prob. of winning | Odds |
|---|---|---|
| No. 1 | 0.503447 | 1.787674 |
| No. 2 | 0.277671 | 3.241246 |
| No. 3 | 0.166548 | 5.403838 |
| No. 4 | 0.052333 | 17.197465 |

| | 2nd place | | | |
|---|---|---|---|---|
| 1st place | −1 | −2 | −3 | −4 |
| 1− | | 0.259327 | 0.190514 | 0.053606 |
| 2− | 0.190682 | | 0.063146 | 0.023843 |
| 3− | 0.109491 | 0.049356 | | 0.007701 |
| 4− | 0.028214 | 0.017067 | 0.007053 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The odds and the probability of winning of the straight bet on horse No. 1 are corrected next. The odds 1.787674 are rounded up to 2, and hence the probability of winning becomes 0.9+2=0.45.

TABLE 19

| | Prob. of winning | Odds |
|---|---|---|
| No. 1 | 0.45 | 2 |
| No. 2 | 0.277671 | 3.241246 |

TABLE 19-continued

| | | |
|---|---|---|
| No. 3 | 0.166548 | 5.403838 |
| No. 4 | 0.052333 | 17.197465 |

| | 2nd place | | | |
|---|---|---|---|---|
| 1st place | −1 | −2 | −3 | −4 |
| 1− | | 0.259327 | 0.190514 | 0.053606 |
| 2− | 0.190682 | | 0.063146 | 0.023843 |
| 3− | 0.109491 | 0.049356 | | 0.007701 |
| 4− | 0.028214 | 0.017067 | 0.007053 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The difference in the probabilities of winning of the straight bet on horse No. 1 is 0.053447. The difference 0.053447 is allocated among "2-1", "3-1", and "4-1" in exacta betting at ratios among the probabilities of winning of "1-2", "1-3", and "1-4" in exacta betting, and the allocated portions are added to the respective probabilities of winning of "2-1", "3-1", and "4-1" in exacta betting. In order not to change the probabilities of winning in quinella betting, the increases in the probabilities of winning in exacta betting are subtracted from "1-2", "1-3", and "1-4", respectively. The probabilities of winning and the odds on horses No. 2 to No. 4 in straight betting are corrected, as shown in Table 20.

TABLE 20

| | Prob. of winning | Odds |
|---|---|---|
| No. 1 | 0.45 | 2 |
| No. 2 | 0.305202 | 2.948868 |
| No. 3 | 0.186774 | 4.818662 |
| No. 4 | 0.058024 | 15.510754 |

| | 2nd place | | | |
|---|---|---|---|---|
| 1st place | −1 | −2 | −3 | −4 |
| 1− | | 0.231796 | 0.170289 | 0.047915 |
| 2− | 0.218212 | | 0.063146 | 0.023843 |
| 3− | 0.129717 | 0.049356 | | 0.007701 |
| 4− | 0.033905 | 0.017067 | 0.007053 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The odds and the probability of winning on the straight bet on horse No. 2 are corrected next. The odds 2.948868 are rounded up to 3, and hence the probability of winning becomes 0.9+3=0.3, as shown in Table 21.

TABLE 21

| | Prob. of winning | Odds |
|---|---|---|
| No. 1 | 0.45 | 2 |
| No. 2 | 0.3 | 3 |
| No. 3 | 0.186774 | 4.818662 |
| No. 4 | 0.058024 | 15.510754 |

| | 2nd place | | | |
|---|---|---|---|---|
| 1st place | −1 | −2 | −3 | −4 |
| 1− | | 0.231796 | 0.170289 | 0.047915 |
| 2− | 0.218212 | | 0.063146 | 0.023843 |
| 3− | 0.129717 | 0.049356 | | 0.007701 |
| 4− | 0.033905 | 0.017067 | 0.007053 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The difference in the probabilities of winning of horse No. 2 is 0.005202. The difference 0.005202 is allocated among "1-2", "3-2", and "4-2" in exacta betting at ratios among the probabilities of winning of "1-3", "2-3", and "2-4" in exacta betting, and the allocated portions are added to the respective probabilities of winning of "1-2", "3-2", and "4-2". In order not to change the probabilities of winning in quinella betting, the increases in the probabilities of winning in exacta betting are subtracted from "2-1", "2-3", and "2-4", respectively. In order not to change the probability of winning in straight betting and the probabilities of winning in quinella betting associated with the straight bet on horse No. 1, the probabilities of winning of "1-3" and "3-1" in exacta betting are corrected. Furthermore, the probabilities of winning and the odds on the straight bets on horses No. 3 and No. 4 are recomputed. This is shown in Table 22.

TABLE 22

| | Prob. of winning | Odds |
|---|---|---|
| No. 1 | 0.45 | 2 |
| No. 2 | 0.3 | 3 |
| No. 3 | 0.191494 | 4.699894 |
| No. 4 | 0.058506 | 15.382948 |

| | 2nd place | | | |
|---|---|---|---|---|
| 1st place | −1 | −2 | −3 | −4 |
| 1− | | 0.235239 | 0.166846 | 0.047915 |
| 2− | 0.214769 | | 0.061870 | 0.023361 |
| 3− | 0.13316 | 0.050633 | | 0.007701 |
| 4− | 0.033905 | 0.017549 | 0.007053 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The odds and the probability of winning of the straight bet on horse No. 3 are corrected next. The odds 4.699894 are rounded up to 5, and hence the probability of winning becomes 0.9+5=0.18, as shown in Table 23.

TABLE 23

| | Prob. of winning | Odds |
|---|---|---|
| No. 1 | 0.45 | 2 |
| No. 2 | 0.3 | 3 |
| No. 3 | 0.18 | 5 |
| No. 4 | 0.058506 | 15.382948 |

| | 2nd place | | | |
|---|---|---|---|---|
| 1st place | −1 | −2 | −3 | −4 |
| 1− | | 0.235239 | 0.166846 | 0.047915 |
| 2− | 0.214769 | | 0.061870 | 0.023361 |
| 3− | 0.13316 | 0.050633 | | 0.007701 |
| 4− | 0.033905 | 0.017549 | 0.007053 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The difference in the probabilities of winning of the straight bet on horse No. 3 is 0.011494. The difference 0.011494 is allocated among "1-3", "2-3", and "4-3" in exacta betting at ratios among the probabilities of winning of "1-4", "2-4", and "3-4" in exacta betting, and the allocated portions are added to the respective probabilities of winning of "1-3", "2-3", and "4-3" in exacta betting. In order not to change the probabilities of winning in quinella betting, the increases in the probabilities of winning in exacta betting are subtracted from "3-1", "3-2", and "3-4", respectively. In order not to change the probabilities of winning of the straight bets on horses No. 1 and No. 2 and the associated probabilities of winning in quinella betting, the probabilities of winning of "1-4", "2-4", "4-1", and "4-2" in exacta betting are corrected. Furthermore, the probability of winning and the odds on the straight bet on horse No. 4 are recomputed. This is shown in Table 24.

TABLE 24

| | Prob. of winning | Odds |
|---|---|---|
| No. 1 | 0.45 | 2 |
| No. 2 | 0.3 | 3 |
| No. 3 | 0.18 | 5 |
| No. 4 | 0.07 | 12.857143 |

| | 2nd place | | | |
|---|---|---|---|---|
| 1st place | −1 | −2 | −3 | −4 |
| 1− | | 0.235239 | 0.173819 | 0.040942 |
| 2− | 0.214769 | | 0.065269 | 0.019961 |
| 3− | 0.126187 | 0.047233 | | 0.006581 |
| 4− | 0.040878 | 0.020949 | 0.008174 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

TABLE 24-continued

| 1st, 2nd place | −2 | −3 | −4 |
|---|---|---|---|
| 1− | 2 | 3 | 11 |
| 2− | | 8 | 22 |
| 3− | | | 61 |

The odds and the probability of winning of the straight bet on horse No. 4 are corrected next. The odds 12.857143 are rounded up to 13, and hence the probability of winning becomes 0.9+13=0.069231, as shown in Table 25.

TABLE 25

| | Prob. of winning | Odds |
|---|---|---|
| No. 1 | 0.45 | 2 |
| No. 2 | 0.3 | 3 |
| No. 3 | 0.18 | 5 |
| No. 4 | 0.069231 | 13 |

| | 2nd place | | | |
|---|---|---|---|---|
| 1st place | −1 | −2 | −3 | −4 |
| 1− | | 0.235239 | 0.173819 | 0.040942 |
| 2− | 0.214769 | | 0.065269 | 0.019961 |
| 3− | 0.126187 | 0.047233 | | 0.006581 |
| 4− | 0.040878 | 0.020949 | 0.008174 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The difference in the probabilities of winning of the straight bet on the last horse No. 4 is 0.000769, and 0.000769 is allocated in proportion to the probabilities of winning in straight betting. The increases in the probabilities of winning of the straight bets on horses No. 1 to No. 3 are reflected in the probabilities of winning in quinella betting associated with "1-4", "2-4", and "3-4" in exacta betting. In order not to change the probabilities of winning in quinella betting, the probabilities of winning of "4-1", "4-2", and "4-3" in exacta betting are corrected. As a result, concerning the probability of winning of the straight bet on horse No. 4, both the decreases in the probabilities of winning caused by correcting the odds in straight betting and the increases in the probabilities of winning caused by allocating the difference in the probabilities of winning of the last bet are reflected, as shown in Table 26.

TABLE 26

| | Prob. of winning | Odds |
|---|---|---|
| No. 1 | 0.450346 | 2 |
| No. 2 | 0.300231 | 3 |
| No. 3 | 0.180139 | 5 |
| No. 4 | 0.069284 | 13 |

TABLE 26-continued

| | 2nd place | | | |
|---|---|---|---|---|
| 1st place | −1 | −2 | −3 | −4 |
| 1− | | 0.235239 | 0.173819 | 0.041288 |
| 2− | 0.214769 | | 0.065269 | 0.020192 |
| 3− | 0.126187 | 0.047233 | | 0.006719 |
| 4− | 0.040531 | 0.020718 | 0.008035 | |

| 1st, 2nd place | −2 | −3 | −4 |
|---|---|---|---|
| 1− | 0.450008 | 0.300006 | 0.08182 |
| 2− | | 0.112502 | 0.04091 |
| 3− | | | 0.014754 |

| 1st, 2nd place | −2 | −3 | −4 |
|---|---|---|---|
| 1− | 2 | 3 | 11 |
| 2− | | 8 | 22 |
| 3− | | | 61 |

The payout rates based on the corrected probabilities of winning and the corrected odds on the straight bets and the quinella bets are shown in Table 27.

TABLE 27

| | |
|---|---|
| No. 1 | 0.900693 |
| No. 2 | 0.900693 |
| No. 3 | 0.900693 |
| No. 4 | 0.900693 |

| 1st, 2nd place | -2 | -3- | 4 |
|---|---|---|---|
| 1- | 0.900017 | 0.900017 | 0.900017 |
| 2- | | 0.900017 | 0.900017 |
| 3- | | | 0.900017 |

Accordingly, the payout rates for the bets in two bet types, i.e., straight betting and quinella betting, are averaged. In other words, it is ensured by the corrected payout rates that a bettor can expect substantially the same payout rate irrespective of which horse the bettor has placed a bet on. In addition, the owner of the gaming machine can make stable profits.

While the present invention has been described with reference to the preferred embodiments, it is to be understood that the invention is not limited to the disclosed embodiments.

For example, the odds can be rounded not only by rounding up. The odds can also be rounded down or rounded off.

The odds can be rounded to an appropriate digit in accordance with the necessity of the payout processing.

The error in the probabilities of winning can be allocated among all bets at a certain ratio, without reference to the ratios among the probabilities of winning of the bets.

The combinations in straight betting or quinella betting can be rearranged in an order other than descending order of probability of winning. For example, all permutations of patterns can be provisionally calculated, and a pattern that achieves a value closest to the target payout rate can be used.

The probabilities of winning and the odds in exacta betting can be similarly corrected by the method of the present invention.

The display device is not limited to one displaying a simulated race using models. Alternatively, the display device may be a cathode-ray tube (CRT) display device for displaying a simulated race using video images on a screen thereof.

In the above embodiments, the bet manager 11, the game progress controller 20, the probability of winning and odds manager 30, the horse data storage unit 31, and the race condition storage unit 32 are separate units or systems in the preprogrammed gaming machine. Alternatively, these units, and particularly the function of the probability of winning and odds manager 30 can be implemented by a combination of a computer in the gaming machine for performing the other functions and a storage medium having recorded thereon predetermined readable program code.

Generally, the storage medium is a non-removable disk or a semiconductor memory that can be read at any time by a central processing unit (CPU) of the computer. Alternatively, a portable medium, such as a floppy disk, a hard disk, an optical disk, a CD-ROM, a digital versatile disk (DVD), or a magnetic tape, which has recorded thereon the program code can be distributed. Also, the program code can be recorded in a computer-accessible program code server or the like to be distributed through telecommunication circuits. The program code can be installed in the non-removable disk or the semiconductor memory upon operation.

The CPU executes the program code to form the probability of winning and odds manager 30 and the like. Alternatively, an operating system performs part of the actual processing based on directions from the program code, thus forming the probability of winning and odds manager 30 and the like.

The running objects, that is, the horses, and the race in the embodiments correspond to objects and a lottery, respectively, in the appended claims. The objects are not limited to the running objects described in the embodiments. The objects may also include flying objects, lottery balls used in bingo games, cards used in card games, the results or the differences in points of sports games, such as baseball and soccer, and the like.

What is claimed is:

1. A gaming machine comprising:

game processing means for executing game processing, wherein said game processing means including dividend determining means for determining a dividend to be paid to a bettor who has won a lottery with a predetermined probability, said lottery including a plurality of objects with predetermined probabilities of winning, and for indicating the dividend to the bettor;

display means for providing an execution result executed by said dividend determining means to the bettor;

said dividend determining means comprising:

setting means for setting a target payout rate and a probability of winning of each of the objects and for setting odds on each of the objects based on the target payout rate and the probability of winning;

ordering means for arranging the objects in order of the probability of winning;

first correction means for approximately correcting the odds on the object in a highest place to odds with a predetermined number of digits, correcting the probability of winning of the object in the highest place based on the corrected odds, reflecting the difference between an uncorrected probability of winning and the corrected probability of winning of the object in the probability of winning of the object in a subsequent place, predetermined the odds on the object in the subsequent place based on the corrected probability of winning of the object in the subsequent place, and repetitively performing a whole processing for the objects in all places; and second correction means for approximately correcting the predetermined odds on the object in last place to odds with a predetermined number of digits, predetermining the probability of winning based on the approximated odds, and again reflecting the difference between the probability of winning and the predetermined probability of winning at predetermined ratios in the probabilities of winning of all the objects, and wherein said display means displaying the final odds obtained by said first and second correction means.

2. A gaming machine according to claim 1, further comprising:

determining means for determining whether a payout rate based on the corrected probabilities of winning and the corrected odds is within a predetermined allowable range of the target payout rate;

wherein, when the determination by said determining means is negative, said dividend determining means resets the probabilities of winning and again performs the processing.

3. A gaming machine according to claim 1, wherein said second correction means again reflects the difference between the probability of winning and the redetermined probability of winning in the probabilities of winning of all the objects at the ratios among the probabilities of winning of the objects in all places.

4. A gaming machine according to claim 2, wherein said second correction means again reflects the difference between the probability of winning in the probabilities of winning of all the objects at the ratios among the probabilities of winning of the objects in all places.

5. A gaming machine comprising:

game processing means for executing game processing, wherein said game processing means including dividend determining means for determining a dividend to be paid to a bettor who has won a lottery with a predetermined probability, said lottery including a plurality of objects with predetermined probabilities of winning, and for indicating the dividend to the bettor;

display means for providing an execution result executed by said dividend determining means to the bettor, said dividend determining means comprising:

setting means for setting a target payout rate and a probability of winning of each of the objects and for setting provisional odds on each of the objects based on the target payout rate and the probability of winning;

ordering means for arranging the objects in order;

first correction means for approximately correcting the odds on the object in first place to odds with a predetermined number of digits, correcting the probability of winning of the object in the first place based on the corrected odds, reflecting the difference between an uncorrected probability of winning and the corrected probability of winning of the object in the probability of winning of the object in a subsequent place, predetermining the odds on the object in the subsequent place based on the corrected probability of winning of the object in the subsequent place, and repetitively performing a whole processing for the objects in all places; and second correction means for approximately correcting the predetermined odds on the object in last place to odds with a predetermined number of digits, predetermining the probability of winning based on the approximated odds, and again reflecting the difference between the probability of winning and the predetermined probability of winning at predetermined ratios in the probabilities of winning of all the objects, and wherein said display means displaying the final odds obtained by said first and second correction means.

6. An operation method for a gaming machine, said game machine comprising:

game processing means for executing game processing, wherein said game processing means including dividend determining means for determining a dividend to be paid to a bettor who has won a bet on a race with a predetermined probability; the race including a plurality of objects with predetermined probabilities of winning, and for indicating the dividend to the bettor, and display means for providing an execution result executed by said dividend determining means;

said operation method comprising the steps of:

setting a target payout rate and a probability of winning of each of the objects and setting odds on each of the objects based on the target payout rate and the probability of winning;

rearranging data on the objects in descending order of the probability of winning; and performing correction processing with said gaming machine, said correction processing including the steps of:

approximately correcting the odds on the object with a highest probability of winning to numeric data with a predetermined number of digits;

correcting the probability of winning based on the corrected odds;

obtaining the difference between the uncorrected probability of winning and the corrected probability of winning;

reflecting the difference in the probability of winning and in the odds on the object in the subsequent place;

repetitively performing the whole processing until the object with the lowest probability of winning is processed;

allocating the difference in the probabilities of winning of the last object among the corrected probabilities of winning of the objects at predetermined ratios; and displaying the final odds obtained by the correction processing on said display means.

7. An operation method for a gaming machine, said game machine comprising:

game processing means for executing game processing, wherein said game processing means including dividend determining means for determining a dividend to be paid to a bettor who has won a bet on a lottery with a predetermined probability in straight betting and quinella betting, said lottery including a plurality of objects with predetermined probabilities of winning, and for indicating the dividend to the bettor, and display means for providing an execution result executed by said dividend determining means, said operation method comprising the steps of:

setting a target payout rate and a probability of winning of each of straight bets and quinella bets and setting odds on each of the straight bets and the quinella bets based on the target payout rate and the probability of winning;

rearranging data on the quinella bets in descending order of the probability of winning;

approximately correcting the odds on the quinella bet with a highest probability of winning to numeric data with a predetermined number of digits, correcting the probability of winning based on the corrected odds, obtaining the difference between an uncorrected probability of winning and the corrected probability of winning, reflecting the difference in the probability of winning and in the odds on the quinella bet in a subsequent place, repetitively performing a whole processing until the quinella bet with the lowest probability of winning is corrected, and allocating the difference in the probabilities of winning of the last quinella bet in accordance with the corrected probabilities of winning of the quinella bets;

reflecting the corrected probabilities of winning of the quinella bets in the probabilities of winning of the straight bets and predetermining the odds on the straight bets;

rearranging data on the straight bets in descending order of the probability of winning; and performing correction processing with said gaming machine, said correction processing including the steps of:

approximately correcting the odds on the straight bet with the highest probability of winning to numeric data with a predetermined number of digits;

correcting the probability of winning based on the corrected odds;

obtaining the difference between the uncorrected probability of winning and the corrected probability of winning;

reflecting the difference in the probability of winning and in the odds on the straight bet in the subsequent place;

repetitively performing the whole processing until the straight bet with the lowest probability of winning is corrected;

allocating the difference in the probabilities of winning of the last straight bet in accordance with the corrected probabilities of winning of the straight bets, and displaying the final odds obtained by the correction processing on said display means.

8. An operation method according to claim 7, wherein, when actual payout rates based on the corrected probabilities of winning and the corrected odds on the straight bets and the quinella bets are not within a predetermined range of the target payout rate, the probabilities of winning in straight betting and quinella betting are reset and the correction processing is performed again.

9. An operation method for a gaming machine, said game machine comprising:

game processing means for executing game processing, wherein said game processing means including dividend determining means for determining a dividend to be paid to a bettor who has won a bet on a race with a predetermined probability, the race including a plurality of objects with predetermined probabilities of winning, and for indicating the dividend to the bettor, and display means for providing an execution result executed by said dividend determining means, said operation method comprising the steps of:

setting a target payout rate and the probability of winning of each of the objects and setting odds on each of the objects based on the target payout rate and the probability of winning;

rearranging data on the objects in order; and performing correction processing with said gaming machine, said correction processing including the steps of:

approximately correcting the odds on the object in first place to numeric data with a predetermined number of digits;

correcting the probability of winning based on the corrected odds;

obtaining the difference between the uncorrected probability of winning and the corrected probability of winning;

reflecting the difference in the probability of winning and in the odds on the object in the subsequent place;

repetitively performing the whole processing until the object in the last place is processed; and allocating the difference in the probabilities of winning of the last object in accordance with the corrected probabilities of winning of the objects, and displaying the final odds obtained by the correction processing on said display means.

10. An operation method according to claim 9, further comprising the steps of:

again performing, when bets in straight betting and quinella betting are set, the correction processing for probabilities of winning and provisional odds in quinella betting:

reflecting the corrected probabilities of winning and the corrected odds in quinella betting in probabilities of winning and odds in straight betting: and redetermining provisional probabilities of winning and provisional odds in straight betting by the correction processing while maintaining the corrected odds and the corrected probabilities of winning in quinella betting.

* * * * *